US007641442B2

(12) United States Patent
Denece et al.

(10) Patent No.: US 7,641,442 B2
(45) Date of Patent: Jan. 5, 2010

(54) DEVICE FOR CONTROLLING CLEARANCE IN A GAS TURBINE

(75) Inventors: Franck Roger Denis Denece, Saint Michel sur Orge (FR); Vincent Philippot, Savigny le Temple (FR)

(73) Assignee: SNECMA, Paris (FR)

( * ) Notice: Subject to any disclaimer, the term of this patent is extended or adjusted under 35 U.S.C. 154(b) by 371 days.

(21) Appl. No.: 11/524,286

(22) Filed: Sep. 21, 2006

(65) Prior Publication Data

US 2007/0071598 A1 Mar. 29, 2007

(30) Foreign Application Priority Data

Sep. 23, 2005 (FR) ..... 05 09749

(51) Int. Cl.
*F01D 11/08* (2006.01)

(52) U.S. Cl. ..... 415/173.1; 415/213.1

(58) Field of Classification Search ..... 415/173.1, 415/108, 116, 209.2, 209.3, 213.1
See application file for complete search history.

(56) References Cited

U.S. PATENT DOCUMENTS

| | | | | |
|---|---|---|---|---|
| 3,975,901 | A * | 8/1976 | Hallinger et al. | 60/786 |
| 4,642,024 | A * | 2/1987 | Weidner | 415/116 |
| 4,752,184 | A * | 6/1988 | Liang | 415/116 |
| 5,984,630 | A * | 11/1999 | Di Salle et al. | 415/174.5 |
| 6,200,091 | B1 * | 3/2001 | Bromann et al. | 415/173.1 |

FOREIGN PATENT DOCUMENTS

DE 25 56 519 A1 7/1976

* cited by examiner

*Primary Examiner*—Ninh H Nguyen
(74) *Attorney, Agent, or Firm*—Oblon, Spivak, McClelland, Maier & Neustadt, L.L.P.

(57) ABSTRACT

The turbine casing includes a circumferential wall coaxially surrounding a ring that surrounds the moving blades of the turbine. The casing includes a plurality of perforations delivering air for ventilating the outside face of the circumferential wall in uniform manner.

10 Claims, 2 Drawing Sheets

DEVICE FOR CONTROLLING CLEARANCE IN A GAS TURBINE

BACKGROUND OF THE INVENTION

The present invention relates to the general field of controlling clearance between the tips of rotary blades and a stationary ring assembly in a gas turbine.

A gas turbine, e.g. a high-pressure turbine of a turbomachine, typically comprises a plurality of stationary vanes disposed in alternation with a plurality of moving blades lying on the path of hot gas coming from the combustion chamber of the turbomachine. The moving blades of the turbine are surrounded around the entire circumference thereof by a stationary ring assembly. The stationary ring assembly defines the passage along which the hot gas flows through the blades of the turbine.

In order to increase the efficiency of such a turbine, it is known to reduce the clearance that exists between the tips of the moving blades of the turbine and the facing portions of the stationary ring assembly to a value that is as small as possible.

To achieve this, means have been devised that enable the diameter of the stationary ring assembly to be varied.

Nevertheless, that solution is found to be insufficient when the support to which the ring is secured also suffers thermal deformation around its circumference and in a manner that is not uniform, where such deformation has the effect of deforming the turbine ring.

OBJECT AND SUMMARY OF THE INVENTION

The present invention seeks to mitigate such drawbacks by proposing a turbine casing in which there can be mounted a support for securing a ring surrounding the moving blades of the turbine, the support having a circumferential wall surrounding the ring coaxially, and the casing including a plurality of perforations enabling air to be delivered for ventilating the outside face of the circumferential wall in uniform manner.

The turbine casing of the invention thus enables the temperature field of the support ring to be made uniform, so that the support deforms in uniform manner around its entire circumference, without any negative influence on the clearance at the tips of the blades.

Preferably, the perforations are formed through an inwardly-directed radial wall of the casing, said wall substantially enclosing a ventilation space that is also defined by an inside face of the casing and by the outside face of the circumferential wall of the support, said face including a small opening for exhausting air.

In a preferred embodiment, the perforations are constituted by same-size holes made through the inner radial wall of the casing and spaced apart regularly around a circumference thereof.

Preferably, the axis of each hole is inclined relative to the axis of the turbine at an angle serving advantageously to impart to the air the rotary motion that is necessary and sufficient for ensuring the looked-for temperature uniformity, i.e. at an angle lying in the range [30°, 60°].

Preferably, this angle is selected to be equal to 45°.

In a preferred embodiment, the axis of each hole is horizontal in a longitudinal section plane of the turbine, such that the rotary motion of the air does not impact directly against the support.

The casing of the invention thus makes it possible both to improve the performance of the engine and to increase the lifetime of the ring support, because the temperature gradients are smaller and the mechanical stresses are thus reduced.

In addition, the invention can be implemented at very low cost.

The invention also provides a turbine as briefly mentioned above, and a turbomachine including such a turbine.

BRIEF DESCRIPTION OF THE DRAWINGS

Other characteristics and advantages of the present invention appear from the following description made with reference to the accompanying drawings which show an embodiment having no limiting character. In the figures.

DETAILED DESCRIPTION OF AN EMBODIMENT

Figure 1:
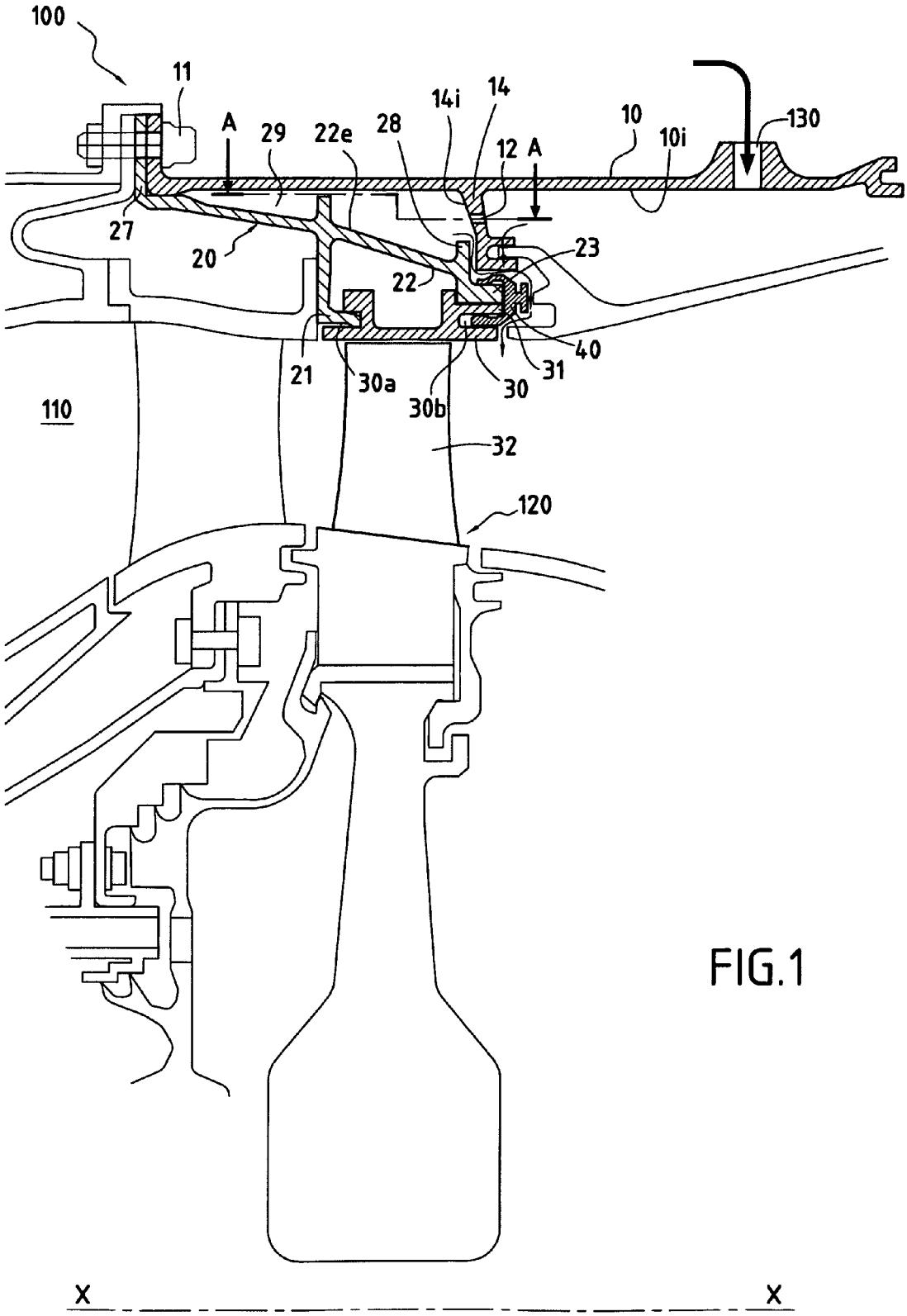
FIG. 1 is a half-view in longitudinal section of a turbomachine in accordance with the invention, in a preferred embodiment.

FIG. 1 is a half-view in longitudinal section showing a turbomachine 100 of the invention in a preferred embodiment.

In conventional manner, the turbomachine 100 includes a combustion chamber 110.

Downstream from the combustion chamber 110, the turbomachine 100 includes a turbine 120 in accordance with the invention, and having a casing in accordance with the invention that is given the reference 10.

In this figure, a stationary ring surrounding the moving blades 32 of the turbine 120 is referenced 30.

The ring 30 is secured to an annular support 20. For this purpose, in the embodiment described herein, the ring 30 has a first circular groove 30*a* in its upstream portion adapted to receive a mounting rail 21 of the support 20.

In its downstream portion, the ring 30 presents a circumferential flat 31 against which there comes to bear an annular edge 23 of the support 20. Substantially at the same level as the first circular groove 30*a*, but on its downstream side, the ring 30 possesses a second circular groove 30*b* substantially under the flat 31.

The downstream portion of the support 20 is thus secured to the ring 30 by an annular retention piece 40 of the C-clip type arranged in the second groove 30*b* to keep the annular edge 23 of the support 20 held pressed against the circumferential flat 31 of the ring 30.

It can thus be understood that any deformation of the support 20 will act via the mounting rail 21 and the annular clamping piece 40 to deform the ring 30, thereby modifying the clearance between the tips of the blades 32 and the inside surface of the ring.

The support 20 has a circumferential wall 22 coaxially surrounding the ring 30, said circumferential wall terminating in its upstream portion in an outwardly-directed radial annular flange 27.

In the example described herein, this radial annular flange 27 serves to secure the support 20 to the casing 10 by means of bolts 11.

Because of this contact, heat is transmitted from the casing 10, via the annular flange 27, to the circumferential wall 22, thereby leading to a temperature field that is highly non-uniform.

The person skilled in the art will understand that this highly non-uniform temperature field tends to deform the support 20 in non-uniform manner around the circumference of the support, thereby running the risk of deforming the clearance between the blades 32 and the inside face of the ring 30, as described above.

In the preferred embodiment described herein the casing 10 presents a radial wall 14 that comes flush with a radial rib 28 of the support 20, thereby defining a chamber 29 that is also defined by the inside face 10*i* of the casing 10 and the outside face 22*e* of the circumferential wall 22.

In accordance with the invention, the turbine casing 10 includes a plurality of perforations 12 serving to deliver air for ventilating the outside face 22*e* of the circumferential wall 22 in uniform manner.

In the embodiment described herein, these perforations 12 are formed through the inwardly-directed radial wall 14 of the casing, with the air escaping from this ventilation chamber 29 via a small opening between the radial rib 28 of the support 20 and the inside face 14*i* of the radial wall 14.

In the preferred embodiment described herein, the air for ventilating the outside face 22*e* of the circumferential wall 22 is taken from a stage of a high-pressure compressor of the turbomachine 100, and is delivered via an inlet 130 formed through the turbine casing 10 downstream from the radial wall 14.

Figure 2:
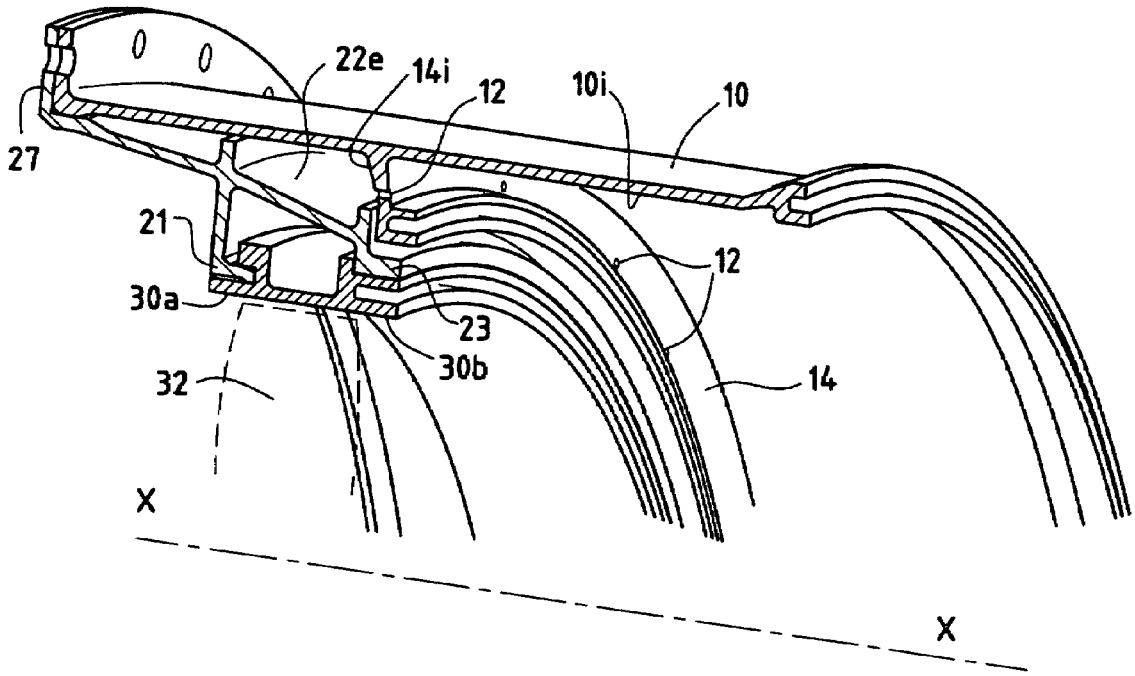
FIG. 2 is a fragmentary perspective view of the turbine casing of the FIG. 1 turbomachine, in its environment.

FIG. 2 is a cutaway fragmentary perspective view of the FIG. 1 casing 10 in its environment.

FIG. 2 corresponds to a preferred embodiment of the casing 10 of the invention, in which the perforations 12 are constituted by same-size holes formed through the inwardly-directed radial wall 14 of the casing 10 and spaced apart regularly around a circumference.

In the embodiment described, this circumference presents twenty-two holes each having a diameter of 1.2 millimeters (mm).

Figure 3:
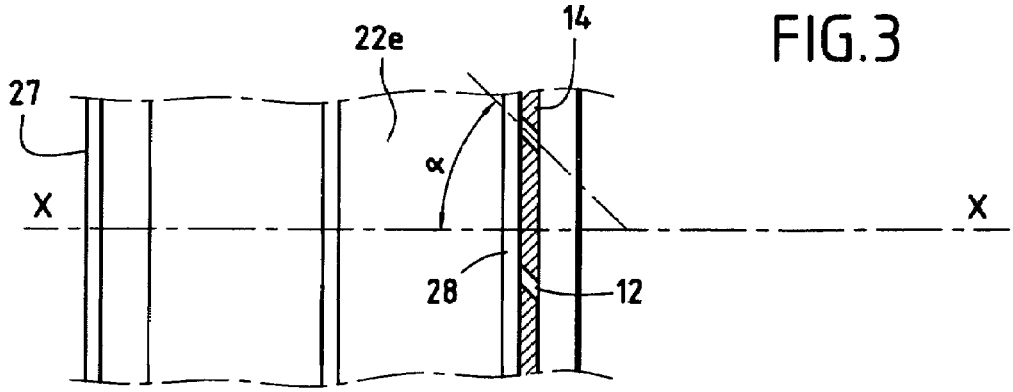
FIG. 3 is a longitudinal section of the FIG. 2 turbine casing.

FIG. 3 is a section view of the assembly of FIG. 1 on a discontinuous line A-A.

FIG. 3 shows the angle $\alpha$ at which the perforations 12 are oriented relative to the axis X-X of the turbine.

In the preferred embodiment described herein, this angle $\alpha$ is an angle of 30° that enables air circulation to be established within the ventilation space 29 that presents rotary motion.

What is claimed is:

1. A casing for a turbine, comprising:

a support for securing a ring surrounding moving blades of said turbine, said support comprising a circumferential wall coaxially surrounding said ring, said casing including a plurality of perforations enabling air coming systematically from a stage of a compressor to be delivered to a ventilation chamber, and the chamber is configured to allow the air to ventilate an outside face of said circumferential wall in a uniform manner, wherein said plurality of perforations are formed through a wall of said casing that extends radially inwards, said wall substantially enclosing the ventilation chamber that is also defined by an inside face of said casing and by the outside face of said circumferential wall of said support, said chamber including a small opening between a radial rib of the support and the inside face of the radial wall for exhausting the air from the chamber.

2. The casing according to claim 1, wherein said perforations are constituted by a plurality of same-sized holes formed through the radially inwardly-extending wall of said casing and spaced apart regularly around a circumference.

3. The casing according to claim 2, wherein a center axis of each of the plurality of same-sized holes is circumferentially inclined relative to an axis of rotation of said turbine at an angle having a range from 30 degrees to 60 degrees to impart rotary motion to the air.

4. The casing according to claim 3, wherein said angle is 45 degrees.

5. A turbine comprising the casing according to claim 1.

6. A turbomachine comprising the turbine according to claim 5.

7. The casing according to claim 1, wherein the circumferential wall is configured to create a uniform tip clearance between tips of the moving blades of said turbine and the ring when the outside face of said circumferential wall is ventilated in the uniform manner.

8. The casing according to claim 1, wherein the casing is configured to exhaust the air from the ventilation chamber in a path which avoids contact with the ring.

9. The casing according to claim 1, wherein the circumferential wall is solid without openings.

10. The casing according to claim 1, wherein the casing further comprises:

a second chamber disposed between the ventilation chamber and the ring, and the air does not pass from the ventilation chamber to the second chamber.

* * * * *